US005282282A

United States Patent [19]

Shehan et al.

[11] Patent Number: 5,282,282

[45] Date of Patent: Feb. 1, 1994

[54] SWIMMING POOL AND COVER

[76] Inventors: Billy C. Shehan; Billy C. Shehan, Jr., 298 E. Mt. Zion Rd., Independence, Ky. 41051; Thomas R. Stubbeman, 309 Main St., Highland Heights, Ky. 41076

[21] Appl. No.: 757,443

[22] Filed: Sep. 10, 1991

Related U.S. Application Data

[62] Division of Ser. No. 488,308, Mar. 5, 1990, Pat. No. 5,065,461.

[51] Int. Cl.[5] ..... E04H 4/14

[52] U.S. Cl. ..... 4/503; 4/506

[58] Field of Search ..... 4/488, 496, 503, 498, 4/506

[56] References Cited

U.S. PATENT DOCUMENTS

| | | | |
|---|---|---|---|
| Re. 27,699 | 7/1973 | Weaver et al. . | |
| D. 293,039 | 12/1987 | Beattie . | |
| 2,517,393 | 8/1950 | Law | 4/503 X |
| 2,755,484 | 7/1956 | Hotz | 52/509 |
| 2,870,454 | 1/1959 | Schippert et al. | 4/503 |
| 2,914,776 | 12/1959 | Hotz | 4/503 X |
| 3,063,062 | 11/1962 | Logan | 4/503 X |
| 3,177,501 | 4/1965 | Kwake | 4/503 X |
| 3,239,975 | 3/1966 | Stier | 4/506 X |
| 3,310,814 | 3/1967 | Lipman | 4/506 X |
| 3,347,006 | 10/1967 | Fox | 4/506 X |
| 3,371,455 | 3/1968 | Fox | 4/506 X |
| 3,419,916 | 1/1969 | Schankler | 4/506 X |
| 3,427,663 | 2/1969 | O'Connell et al. | 52/588 |
| 3,511,002 | 5/1970 | Fox | 4/506 X |
| 3,512,326 | 5/1970 | Greene | 4/506 X |
| 3,524,291 | 8/1970 | Rozanski | 4/506 X |
| 3,535,840 | 10/1970 | Fontana | 4/506 X |
| 3,555,573 | 1/1971 | Turner | 4/498 X |
| 3,628,198 | 12/1971 | Katzman | 4/503 X |
| 3,667,071 | 6/1972 | Hoch et al. | 4/506 X |
| 3,750,197 | 8/1973 | Weir et al. | 52/169.7 |
| 3,758,099 | 9/1973 | Scott | 269/58 |
| 3,906,688 | 9/1975 | Witte | 52/152 |
| 3,938,199 | 2/1976 | Laven | 4/506 X |
| 3,975,874 | 8/1976 | Witte et al. | 52/169.7 |
| 4,004,386 | 1/1977 | Diffenderfer | 4/506 X |
| 4,011,607 | 3/1977 | Davidoff | 4/503 |
| 4,047,340 | 9/1977 | Witte et al. | 52/169.7 |
| 4,064,571 | 12/1977 | Phipps | 4/503 X |
| 4,094,021 | 6/1978 | Rapp | 4/503 |
| 4,107,826 | 8/1978 | Tysdal | 4/498 X |
| 4,158,244 | 6/1979 | Stefan | 4/496 |
| 4,182,087 | 1/1980 | Schall et al. | 4/506 X |

(List continued on next page.)

FOREIGN PATENT DOCUMENTS

| | | | |
|---|---|---|---|
| 2214799 | 9/1989 | United Kingdom | 4/506 |

OTHER PUBLICATIONS

Torlan Pool Products Inc. "Introducing a Break--Through in Winter Covers for Existing Pools!" no effective date given.

"Fiberstars Vinyl Liner Pool Installations are a Snap!" by Fiberstars Inc. no effective date given.

*Primary Examiner*—Robert M. Fetsuga

*Attorney, Agent, or Firm*—Wood, Herron & Evans

[57] ABSTRACT

An improved swimming pool construction and cover includes a swimming pool cover laid on the water of the pool and having a marginal edge provided with one component of the two component elongated locking member. The second component of the locking member is disposed in the pool coping or deck edge accessible at the pool interior for engagement by the locking member component on the pool cover. The locking component associated wit the pool is provided in a retrofit configuration by securing a locking component to a vinyl liner bead lock secured in the vinyl liner bead channel in a pool coping. In a new vinyl-lined pool construction, a coping is provided with a secondary channel with one component of the cover locking member secured therein. In a gunnite pool, a channel is formed in the deck edge and a component of the releasable cover locking member is secured in the channel for securement of the pool cover thereto. Apparatus and methods are disclosed.

1 Claim, 2 Drawing Sheets

U.S. PATENT DOCUMENTS

| | | | |
|---|---|---|---|
| 4,197,595 | 4/1980 | Dearing | 4/503 |
| 4,203,170 | 5/1980 | Lankheet | 4/506 |
| 4,229,844 | 10/1980 | Cribben et al. | 4/506 X |
| 4,335,474 | 6/1982 | Bailey | 4/506 |
| 4,429,425 | 2/1984 | Weir et al. | 4/503 |
| 4,457,119 | 7/1984 | Dahowski | 4/506 X |
| 4,490,067 | 12/1984 | Dahowski . | |
| 4,497,152 | 2/1985 | Weissner | 4/506 X |
| 4,548,009 | 10/1985 | Dahowski | 52/396 |
| 4,589,237 | 5/1986 | Dahowski | 4/506 X |
| 4,603,521 | 8/1986 | Engelhart | 4/506 X |
| 4,628,549 | 12/1986 | Lazar | 4/498 X |
| 4,698,109 | 10/1987 | Lazar | 4/498 X |
| 4,713,849 | 12/1987 | Kindness | 4/496 |
| 4,735,395 | 4/1988 | Dahowski | 4/506 X |
| 4,797,957 | 1/1989 | Weir et al. | 4/506 |
| 4,825,341 | 4/1989 | Awai | 362/32 |
| 4,829,732 | 5/1989 | Dahowski et al. | 52/298 |
| 4,967,424 | 11/1990 | Stegmeier | 4/496 |
| 4,974,266 | 12/1990 | Vultaggio et al. | 4/506 |
| 4,980,934 | 1/1991 | Dahowski et al. | 4/496 |
| 5,065,461 | 11/1991 | Shehan et al. | 4/503 |
| 5,068,929 | 12/1991 | Weiner | 4/503 |

SWIMMING POOL AND COVER

This is a division of application Ser. No. 07/488,308, filed Mar. 5, 1990.

This invention relates to swimming pool covers and more particularly to apparatus for releasably attaching swimming pool covers in deployed condition over a pool.

Many installed swimming pools today are of either gunnite or vinyl liner construction. Covers for both are desirable, particularly during any non-use season, such as winter, but as well for maintaining water temperature during short periods of non-use. Such covers serve to block debris from entering the water, and may serve as a safety factor.

In the past, numerous cover securing systems have been devised. Known systems, however, can be very expensive, and whether or not expense is considered, they may present significant use and maintenance problems.

For example, one current cover is designed to lay over a pool and has an edge portion lying on the adjacent pool deck. The edges of the cover are secured to tie-down points disposed on the deck. Such covers can be very expensive. Moreover, moisture, debris and other items can migrate or be blown under the cover, between the cover and deck surface where the moisture does not readily dry. This can cause staining of the pool deck. Also, water can migrate into cracks or voids in the deck surface and wintertime freeze-thaw cycles can cause the surface to chip, crack or slough away.

In another form of widely-used cover, water bags are used to hold down the cover edge portions on the deck surface. This is even more conducive to staining, deck degradation and the like. The presence of moisture, which does not readily dry, between the cover and deck is highly undesirable. Also, the water bags themselves are frequently difficult or worrisome to deal with, and occasionally leak.

In both these instances, the covers are secured to keep them from blowing away, while at the same time securing the pool. Of course, where the cover is stretched, its weight and loading must be accommodated by the securing devices or bags even when the cover may touch the pool water in the middle. This loading can be significant in a high wind.

Accordingly, it is desirable to provide an improved pool cover and mounting apparatus which does not present these problems, yet is still capable of securing the cover in operative disposition with regard to the pool.

Another consideration concerning pool covers is whether or not the cover is furnished as part of an original pool installation, or as an after construction purchase or retrofit.

If the pool is installed prior to any consideration given to the cover, a retrofit might require further construction inside the pool, or on the pool deck, causing dust, dirt and other debris to enter the pool system.

In the vinyl-lined pools, it is typical to use a coping forming and comprising the upper edge of the pool extending around the pool wall. Frequently, the coping will be set on the wall top, and a concrete deck will be poured around the pool, the coping serving as a form, which remains in place, for the deck edge surrounding the pool.

Such copings are frequently provided with a longitudinally extending channel in the coping's lower edge. The vinyl liner has a bead which is disposed in the channel just above the pool wall. This bead secures the liner in place above the projected water surface. It is also known to provide an additional channel in the coping for securing a dome structure over the pool. There are no known provisions in this construction for a cover of the type extending across the pool proximate the water level or between the pool walls.

In the gunnite pool, gunnite forms the pool walls and concrete or a concrete and gunnite or other material combination forms the pool deck. Frequently, the pool deck edge is poured in a cantilevered disposition over the water. In each of such pool constructions, covers of the foregoing types are used, with the attendant problems.

Accordingly, it has been one objective of this invention to provide an improved pool cover with improved means of securing the cover to the pool structure.

Another objective of this invention has been to provide an improved pool cover with improved means for releasably attaching the cover to the pool, and which can be provided as a retrofit or as original construction apparatus.

A further objective of the invention has been to provide an improved pool cover and cover attachment means for use in a gunnite pool having a cantilevered deck edge.

A further objective of the invention is the provision of a single pool cover and means for attaching the cover to a pool either as a retrofit or originally supplied cover for vinyl-lined pools or for gunnite pools.

A still further objective of the invention has been to provide pool structure and pool construction methods involving improved pool covers and releasable pool cover attachment means.

To these ends, the invention contemplates use of an elongated, two-component releasable locking member to secure the edge of a cover to the upper pool edge structure while the cover primarily rests on the water surface. One embodiment of the invention includes a retrofit pool cover and releasable attachment apparatus for a vinyl-lined pool. An elongated liner bead lock has one horizontally disposed leg for insertion into a deck coping channel to lock the liner bead therein, and a second vertical leg to which is secured one component of an elongated releasable locking member, such as a velcro hook and loop fastener or similar, flexible post fasteners of the 3M Company ("Dual-Lock"). A pool cover is provided at a marginal edge with another component of the releasable locking member. The cover is laid across the water in the pool and the cover edges adjacent the pool's walls extending upwardly so the portions of the locking members can be engaged, thereby securing the cover to the pool. The pool cover is thus easily retrofitted to existing vinyl-lined pools.

In another embodiment of the invention for use in original vinyl-lined pool constructions, a deck coping is provided with a vinyl-liner, bead locking first channel and an elongated second channel disposed thereabove. One operative portion or component of a two-component, releasable locking member is disposed in the second channel and the cover as described in the first embodiment just above is releasably secured thereto.

In a third embodiment, a gunnite pool is provided with either a cantilevered deck having an edge extending over the water, or a straight vertical edge. The deck is poured against a form having a longitudinal projection which creates a trough or channel in the concrete edge. Thereafter, an operative portion or component of a two-component, releasable locking member is secured in the trough. The pool cover, as described in the preceding two embodiments, is releasably attached thereto.

In each of these embodiments, the pool cover is disposed across the top of the water, with its edges extending upwardly at the pool walls and continuously, releasably attached to the pool's upper edge. The cover preferably rests primarily on the water. With only several inches of vertical edge disposition, the weight of the cover hanging by the releasable locking members is small and the cover can easily be maintained in secure attached condition. No water bags or other hold downs are required. No tie-down points, screws, bolts or other latching members are necessary. The pool cover in each case does not extend onto the pool deck and does not trap moisture or debris against the deck surface, nor promote staining. Moreover, the retrofit embodiment does not require any construction around the pool, only insertion of the bead locking, cover latching member.

According to the invention, an improved pool cover apparatus is thus provided either for new vinyl-lined pools in construction, as a retrofit for existing vinyl-lined pools, or for gunnite pools.

These and other objectives and advantages will be readily apparent from the following description of various embodiments of the invention and from the drawings in which.

DETAILED DESCRIPTION OF THE INVENTION

Figure 1:
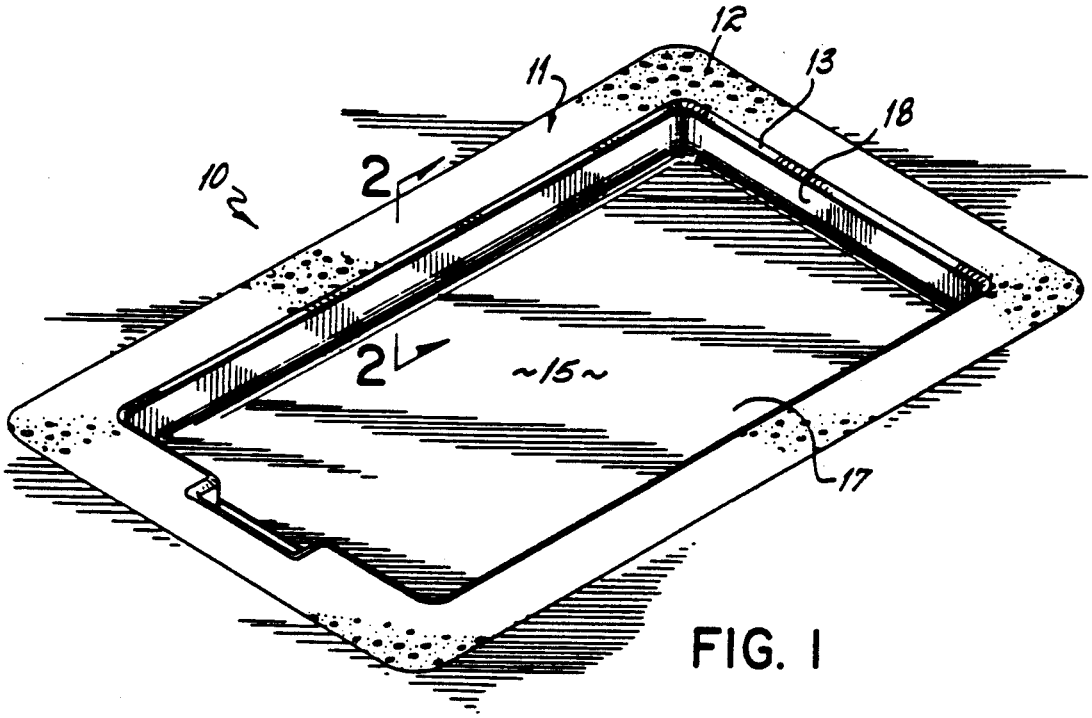
FIG. 1 is a perspective view of a pool and surrounding deck, the pool fitted with a cover according to the invention.

Turning now to the drawings that are shown in FIG. 1 a swimming pool with cover structure 10. The pool includes a pool deck 11 having an upper surface 12 surrounding the pool. The deck terminates inwardly and toward the interior of the pool at a curved deck edge 13 as diagrammatically shown in the figures. A pool cover 15 is disposed over the water of the pool. Pool cover 15 has a horizontally extending portion 17 and a vertically extending portion 18 as perhaps best seen in FIG. 2. The pool further has a plurality of pool walls 14 which may comprise concrete, gunnite, backfill, peat gravel, etc. In the case of some forms of vinyl-lined pools such as those shown in FIGS. 3 and 4 the pool wall may also include a steel plate 19.

In addition, and with reference to FIGS. 2, 3 and 4, vinyl-lined pools may also include a subdeck member 20 of any suitable material and construction for supporting the deck 11 and the edge coping, which may be disposed thereon as will be hereinafter described.

Turning now momentarily to cover 15 it will be appreciated that the invention contemplates the utilization of a multiple-component, releasable locking member for securing the cover 15 to the pool structure. Various releasable locking means could be utilized in this connection. Preferably, applicant contemplates the use of a two component, releasable locking means or member such as velcro hook and loop fasteners or other releasable elongated locking means such as the multiple-component "Duo-Lok" fastening apparatus produced by the 3M Company. Such two component elongated locking fasteners have a first component secured to one member and a second component secured to another member. The two components may be pushed together in order to releasably lock the two members together and may be pulled apart in order to release the engagement. Returning now momentarily to FIG. 2 for example, a first elongated component 24 of the two component elongated releasable locking member is positively secured to the cover 15. A second elongated component 25 of the two component locking member is secured to the pool structure as will be described. Accordingly, the cover 15 is secured on the pool by means of this locking member.

It will also be appreciated that the first elongated component 24 and the second elongated component 25 form the two component elongated locking member 26 and that each of the components 24 and 25 preferably extend respectively around the cover edge and around the edge of the pool. Nevertheless, it should be appreciated that one or the other of the components may not be continuous, and that short, cooperating sections of each of the components might be used even though preferably the entire edge of the cover is secured continuously around the edge of the pool.

Figure 2:
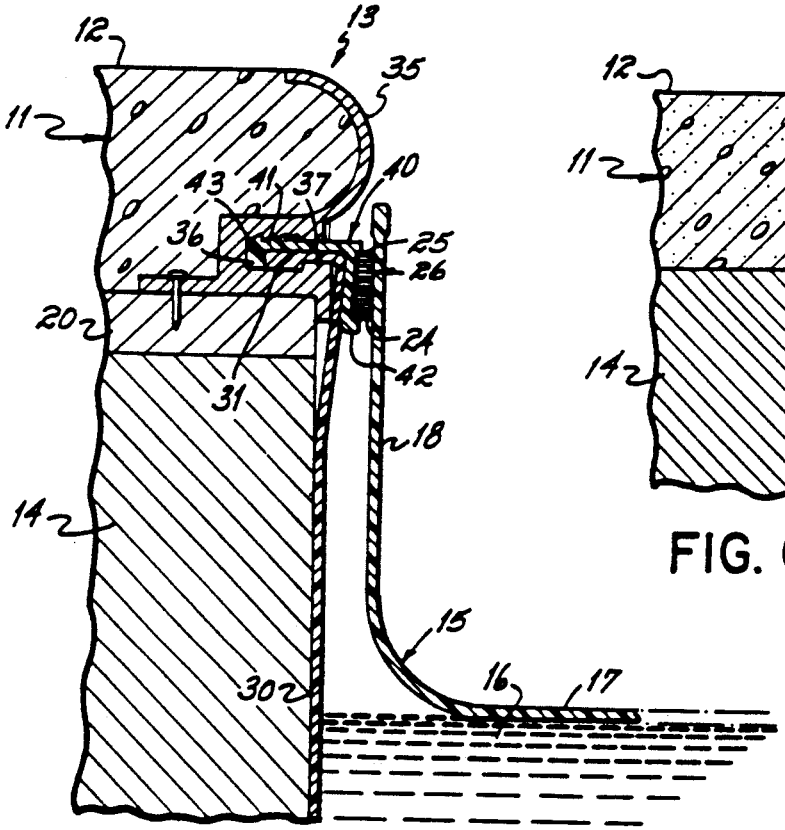
FIG. 2 is a cross-sectional view taken in lines 2—2 of the invention particularly adapted for retrofit to an existing vinyl-lined pool.
Figure 3:
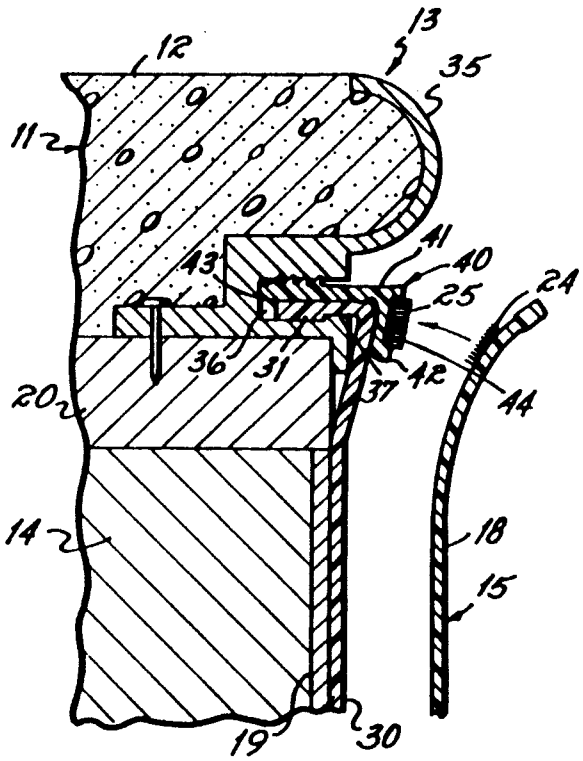
FIG. 3 is a cross-sectional view showing the pool cover of FIG. 2 separated from the pool side.

Turning now to FIGS. 2 and 3, there is disclosed therein structure which is adapted for retrofitting an existing vinyl-lined pool with a pool cover according to the invention. As shown in these two figures, the pools are provided with a vinyl liner 30. The pool construction as shown in FIG. 2 has a pool wall 14 of concrete or other material over which the liner 30 lies. As shown in FIG. 3, the pool wall includes a plate such as a steel plate 19 backed by concrete, backfill, pea gravel or the like. The vinyl liner 30 is provided with an enlarged edge bead 31 disposed around the edge of the liner. An edge coping 35 is disposed around the upper edge of the pool wall 14, 19. The coping is secured by any suitable known means to the subdeck 20 and is provided with an elongated channel 36 in which is disposed the edge bead 31. As shown the channel 36 is provided with a lip 37 to facilitate retention of the liner edge bead 31 within the channel, and the liner 30 thereby in place.

The coping 35 defines an interior edge of the deck 12, preferably curved as at 13. There is no provision however, in such construction as it may currently exist in any particular pool for the securement of the cover thereto.

According to the invention, a bead locking member 40 is provided for both locking the liner bead 31 in the channel 36 and for providing retrofit of apparatus for securing the pool cover to the pool. The bead locking member 40 includes a first horizontal leg or portion 41 and a second or vertical leg or portion 42. The horizontal leg 41 may have a depending elongated portion 43 to facilitate locking the bead locking member 40 and the bead 31 within the channel 36. The face of the second vertical leg 42 is provided with an elongated trough or channel 44 and one component 25, of the two component locking member 26, is positively secured to the bead locking member 40 as shown in FIGS. 2 and 3. Of course, it will be appreciated that FIG. 2 depicts the cover 15 in a releasably secured position as it would reside when the cover is in place. FIG. 3 illustrates the cover being separated from the releasable locking apparatus of the pool structure for the purposes of illustration.

It will also be appreciated that the channel 36 is disposed beneath the surface 12 of the deck 11 and that the peripheral edge area 18 of the cover 15 extends upwardly from the surface of the water 16 and terminates short of the deck surface 12 so that the cover does not lie on the deck surface.

Accordingly, the bead locking member as described is retrofitted to an existing vinyl-lined pool having a coping as described. The cover as described herein is utilized in conjunction therewith for providing a secure pool cover with elimination of any deck inserted tie-down points and without need to cover any of the pool deck with the pool cover itself such as might promote deck staining, degradation or the like. When in place, cover 15 resides on the surface of the water 16 and has a relatively small portion extending upwardly in engagement with the two component locking member. This securely fastens the cover in place around the pool for the prevention of the ingress of debris to the pool water and eliminates any undue strain on the two component locking member. It is believed that the contact of the cover 15 with the water surface 16 over substantially the entire pool serves to aid in maintaining the cover in place even in the presence of high winds while, of course, the edges of the cover are locked to the pool structure releasably.

Figure 4:
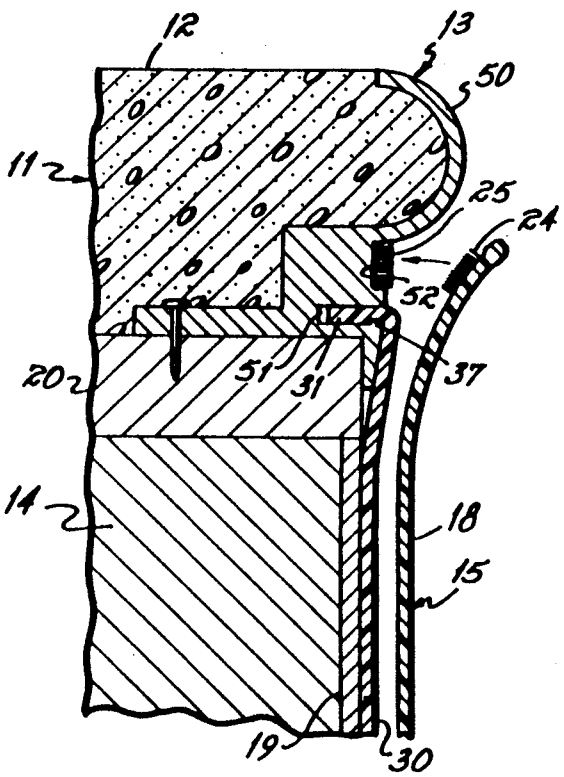
FIG. 4 is a cross-sectional view of the invention adapted for use in new pool construction.

Turning now to FIG. 4, there is disclosed therein a pool coping for use with newly constructed vinyl-lined pools adapted for the securement of a cover 15 to the pool structure. It will be appreciated that components with similar designation numbers in the drawings are similar to each other throughout the various embodiments.

In FIG. 4, a vinyl-lined pool is constructed having wall plates such as steel plates 19 therein backed up by concrete, backfill, pea gravel, or the like. A subdeck 20 is disposed on top of the wall and a coping 50 is disposed on the subdeck 20. Thereafter the deck 11 is poured with the coping forming the interior edge of the deck 11. The coping 50 includes a first lower channel 51 for receiving the bead 31 of the liner 30. The coping has a second upper channel 52 extending along the coping parallel to and above the lower channel 51. A component 25 of an elongated two component releasable locking member is secured in the channel 52 beneath the deck surface 12 but above the channel 31.

Once the pool has been constructed and the vinyl liner disposed with the bead 31 and channel 51, the pool is utilized. When it is desired to place the cover 15 thereon the cover is disposed across the top of the water in the pool and the upper edges 18 of the cover have secured thereto a second component 24 of the two component locking member. The component 24 is engaged operatively with the component 25 to secure and maintain the cover in place.

It will, of course, be appreciated in this embodiment and in the embodiment shown in FIGS. 2 and 3 that the components 25 are disposed in the bead locking member 40 and in the respective channel 52 such that each component is exposed to the interior of the pool. In this fashion, an improved pool construction and cover therefor is provided by means of the coping as described.

Figure 6:
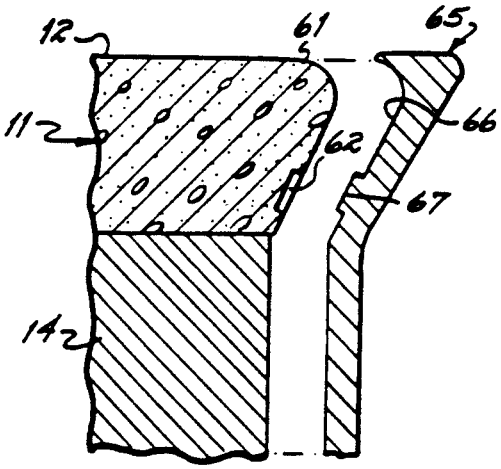
FIG. 6 is a diagrammatic view of a form used to define a cantilevered pool deck edge in the gunnite pool of FIG. 5.
Figure 5:
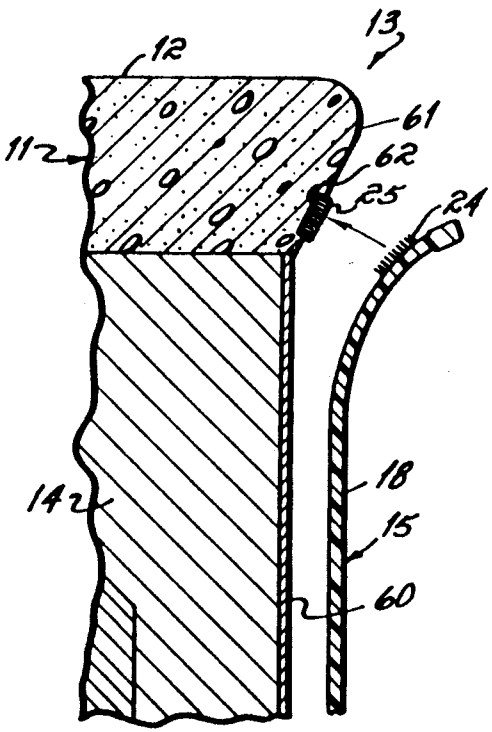
FIG. 5 is a cross-sectional view of the invention adapted for use with gunnite pools.

Turning now to FIGS. 5 and 6, there is disclosed therein an embodiment of the invention utilized in connection with a gunnite type pool having a layer of gunnite 60 formed over the pool wall 14. A deck 11 is poured on top of the wall 14 and terminates in a deck edge 61 in a preferably cantilevered fashion toward and over the pool. The deck 11 is of pourable material, such as cementitious material like concrete, and may have a pool decking surface formed from a thin coating of material thereon just as might be utilized in connection with the other embodiments. An elongated trough or channel 62 is disposed as shown in FIG. 6 in the deck edge 61. One component 25 of a two component locking member as described above is secured in the elongated channel 22 with another component of a two component locking member is secured at peripheral 18 of the cover 15 such that the cover can be secured to the pool structure by means of the releasable engagement of the components 24 and 25 as indicated in FIG. 5. It will be appreciated that the trough 62 is disposed in the deck edge 61 such that the component 25 is exposed to the interior of the pool just above the pool wall and below the deck surface 12.

Turning now to FIG. 6 there is shown diagrammatically therein a form 65 used in forming the deck edge 61 of the embodiment shown in FIG. 5. Form 65 is provided with a curve surface 66 defining the desired deck edge shown in FIG. 5. Surface 66 is provided with a projection 67 elongated in form parallel to the top edge of the pool wall 14. When the form is moved to the left as shown in FIG. 6 and positioned for forming the deck edge (and perhaps the pool wall as well) the pourable deck material is poured to form the deck 11 with the curved edge 66 of form 65 and a protrusion 67 defining the edge surface of the deck along the pool wall. Once the deck material has hardened to form the deck 11, the form 65 is removed, leaving the formed deck edge together with the trough or channel 62 formed therein for securement therein of the component 25 of the two component locking member. Again, while it may be suitable to make the protrusion 67 in a discontinuous format it is preferable to form a continuous elongated channel 22 around the pool for receiving continuous locking component 25.

Of course, a cover as described herein could be retrofit to an existing gunnite pool by adhesively securing one component of the releasable locking member to the deck edge or upper pool wall for cover attachment thereto.

Accordingly it will be appreciated that the invention contemplates several different embodiments, all of which provide an improved pool cover and releasable locking means for securing the cover to an existing vinyl-lined pool on a retrofit basis, to a newly constructed vinyl-lined pool, or to a gunnite pool. The upper surface of the cover terminates well short of the deck surface 12 preventing staining or deck degradation and eliminating the use of any deck surface tie-downs or water bags or the like while at the same time providing a secure pool cover to the pool surface.

It will be appreciated in each of these embodiments that the pool covers are similarly constructed, depending, of course, on size and shape of the pool.

These and other advantages and modifications will be readily apparent to those of ordinary skill in the art without departing from the scope of the invention, and the applicant intends to be bound only by the claims appended hereto.

What is claimed is:

1. A swimming pool having walls and a deck disposed about upper portions of such walls, said deck having a deck edge facing inwardly toward said pool, said pool further comprising:

two separate elongated channels disposed in said deck edge, one above the other;

a swimming pool liner having a liner edge bead, said bead disposed in a first one of said channels for supporting said liner over said pool walls, a pool cover, a multiple component pool cover fastener means, one component of said fastener means operatively secured to said pool cover, and another of said components of said fastener means being secured in a second one of said channels with a portion thereof being exposed outwardly of said second channel above and outwardly of said first channel, said two components being releasably securable together along said outwardly exposed portion outside said second channel to secure said cover over said pool between said walls of said pool and around said deck edge; and wherein said fastener means components comprise hook members and loop members, each mounted on a respective backing, said exposed portion of one of said components comprising one of said hook members and said loop members.

* * * * *